US007603053B2

(12) United States Patent
Hosokawa et al.

(10) Patent No.: US 7,603,053 B2
(45) Date of Patent: Oct. 13, 2009

(54) IMAGE FORMING APPARATUS

(75) Inventors: Hiroshi Hosokawa, Kanagawa (JP); Hiroyuki Nagashima, Kanagawa (JP); Nobuo Kuwabara, Kanagawa (JP); Hirotaka Hatta, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 11/736,881

(22) Filed: Apr. 18, 2007

(65) Prior Publication Data

US 2007/0280725 A1 Dec. 6, 2007

(30) Foreign Application Priority Data

May 1, 2006 (JP) ..... 2006-127671

(51) Int. Cl.
*G03G 15/08* (2006.01)

(52) U.S. Cl. ..... 399/103; 399/105

(58) Field of Classification Search ..... 399/102, 399/103, 105, 106, 119, 262
See application file for complete search history.

(56) References Cited

U.S. PATENT DOCUMENTS

| | | | | |
|---|---|---|---|---|
| 6,097,907 | A * | 8/2000 | Fujiwara | 399/106 |
| 6,118,958 | A * | 9/2000 | Nagashima | 399/105 |
| 7,106,991 | B2 | 9/2006 | Hosokawa et al. | |
| 2004/0096239 | A1 | 5/2004 | Hosokawa et al. | |
| 2005/0025520 | A1 | 2/2005 | Murakami et al. | |
| 2005/0158071 | A1 | 7/2005 | Hosokawa et al. | |
| 2005/0191081 | A1 | 9/2005 | Muraishi et al. | |
| 2005/0226656 | A1 | 10/2005 | Tsuda et al. | |
| 2005/0238384 | A1 | 10/2005 | Sampe et al. | |
| 2005/0271420 | A1 | 12/2005 | Arai et al. | |
| 2006/0008296 | A1 | 1/2006 | Sampe et al. | |
| 2006/0018680 | A1 | 1/2006 | Hosokawa et al. | |
| 2006/0062594 | A1 | 3/2006 | Kawasumi et al. | |
| 2006/0062612 | A1 | 3/2006 | Kimura et al. | |
| 2006/0115302 | A1 | 6/2006 | Hosokawa et al. | |
| 2006/0275053 | A1 | 12/2006 | Nagashima et al. | |

FOREIGN PATENT DOCUMENTS

| | | |
|---|---|---|
| JP | 3402872 | 2/2003 |
| JP | 2006-23619 | 1/2006 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

A development device that has communication port sealing means for sealing a communication port communicating a developer supporter container with a developer container. The development device is advantageous in cost reduction, easy manufacturing, and formation of high-quality images. In the development device which has a developing roller container for containing a developing roller, a developer container for containing a developer, a base member for forming a communication port communicating the developer roller container with the developer container, and a seal member that is adhered to the base member so as to cover the communication port, and which cancels sealing of the communication port by peeling off the seal member from the base member by pulling out the seal member in a direction parallel to an opened surface of the communication port, the base member is composed of a polypropylene resin having a bent section, and the seal member is adhered to the base member by thermal compression bonding.

8 Claims, 5 Drawing Sheets

IMAGE FORMING APPARATUS

BACKGROUND OF THE INVENTION

1. Field of the Invention

The present invention relates to an image forming apparatus such as a copying machine, facsimile apparatus, printer or the like, and more particularly to a development device used in such image forming apparatus, as well as a process cartridge using the development device.

2. Description of the Background Art

As a development device that is used in this type of image forming apparatus, there has conventionally be known a development device that has a developer supporter container, a developer container for storing the developer, a communication port communicating the developer supporter container with the developer container, and communication port sealing means for sealing the communication port. By providing the communication port sealing means in the development device, the developer can be prevented from leaking and dispersing from an opening section of the developer supporter container when carrying the development device alone. Also, since the developer is separated from the external air, deterioration of the developer that is caused when the developer contacts with the air can be prevented.

For example, Japanese Unexamined Patent Application Publication No. 2006-23619 discloses a development device that is provided with the communication port sealing means having a frame body for forming the communication port, and a seal member adhered to the frame body so as to cover the communication port. In this development device, the seal member adhered to the frame body of the communication port sealing means is peeled off when starting to use the development device, whereby the development supporter container and the developer container can be communicated with each other, and the developer can be supplied to the developer supporter container.

However, this conventional developer apparatus had to be designed such that the sheet thickness of the frame body of the communication port sealing means had to be thick in order to ensure the strength thereof for peeling off the seal member, or a bent section had to be provided on an end section of the frame body. In the case in which a PET resin (polyethylene terephthalate resin) is used as the material of the frame body, thickening the sheet thickness leads to increase of the cost. Moreover, when providing the bent section by means of a thick PET resin material, cracks and scuffing are formed on the bent section due to its hardness, causing poor mold formability. Furthermore, the seal member formed from a PET film into a two-sided tape was generally adhered to the frame body composed of the PET resin. However, when pulling out the seal member the two-sided tape that is nearly peeling off abuts on the developer supporter, whereby a developer layer on the developer supporter is sometimes damaged, or the completely peeled two-sided tape enters the developer supporter container, resulting in a defective image with white stripes and the like. Therefore, there was a problem that the use of such two-sided tape to adhere the seal member is not enough to obtain a high-quality image.

Technologies relating to the present invention are also disclosed in, e.g., Japanese Patent Application No. 3402872.

SUMMARY OF THE INVENTION

The present invention is contrived in view of the background described above, and an object thereof is to provide a development device that has communication port sealing means for sealing a communication port communicating a developer supporter container with a developer container, and that is capable of realizing cost reduction, easy manufacturing and formation of high-quality images, a process cartridge having this development device, and an image forming apparatus having either one of the above devices.

In an aspect of the present invention, there is provided a development device which comprises a developer supporter container for containing a developer supporter; a developer container for containing a developer supplied to the developer supporter; a frame body for forming a communication port that communicates the developer supporter container with the developer container; and a seal member that is adhered to the frame body so as to cover the communication port. Sealing of the communication port is canceled by peeling off the seal member from the frame body by pulling out the seal member in a direction parallel to an opened surface of the communication port. The frame body is composed of a polypropylene resin having a bent section, and the seal member is adhered to the frame body by thermal compression bonding.

In another aspect of the present invention, there is provided a process cartridge in which at least a latent image supporter and a development device for developing a latent image on the latent image supporter are integrally supported, and which is configured detachably with respect to an image forming apparatus main body. The development device comprises: a developer supporter container for containing a developer supporter; a developer container for containing a developer supplied to the developer supporter; a frame body for forming a communication port that communicates the developer supporter container with the developer container; and a seal member that is adhered to the frame body so as to cover the communication port. Sealing of the communication port is canceled by peeling off the seal member from the frame body by pulling out the seal member in a direction parallel to an opened surface of the communication port. The frame body is composed of a polypropylene resin having a bent section, and the seal member is adhered to the frame body by thermal compression bonding.

In another aspect of the present invention, there is provided an image forming apparatus which comprises a charging device for charging a surface of a latent image supporter; a latent image forming device for forming an electrostatic latent image on the latent image supporter; and a development device for developing the electrostatic latent image to form a toner image. The development device comprises: a developer supporter container for containing a developer supporter; a developer container for containing a developer supplied to the developer supporter; a frame body for forming a communication port that communicates the developer supporter container with the developer container; and a seal member that is adhered to the frame body so as to cover the communication port. Sealing of the communication port is canceled by peeling off the seal member from the frame body by pulling out the seal member in a direction parallel to an opened surface of the communication port. The frame body is composed of a polypropylene resin having a bent section, and the seal member is adhered to the frame body by thermal compression bonding.

In another aspect of the present invention, there is provided a color image forming apparatus which comprises a charging device for charging a surface of a latent image supporter; a latent image forming device for forming an electrostatic latent image on the latent image supporter; and a plurality of development devices for developing the electrostatic latent image to form a toner image. Each of the development devices comprises: developer supporter container for containing a developer supporter; a developer container for containing a developer supplied to the developer supporter; a frame body for forming a communication port that communicates the developer supporter container with the developer container; and a seal member that is adhered to the frame body so as to cover the communication port. Sealing of the communication port is canceled by peeling off the seal member from the frame body by pulling out the seal member in a direction parallel to an opened surface of the communication port. The frame body is composed of a polypropylene resin having a bent section, and the seal member is adhered to the frame body by thermal compression bonding.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Hereinafter, an electrophotographic printer (simply referred to as "printer 100" hereinafter) is described as an embodiment of the image forming apparatus to which the present invention is applied. It should be noted that an image formation section is described as the process cartridge.

First of all, the basic configuration of the printer 100 is described.

Figure 1:
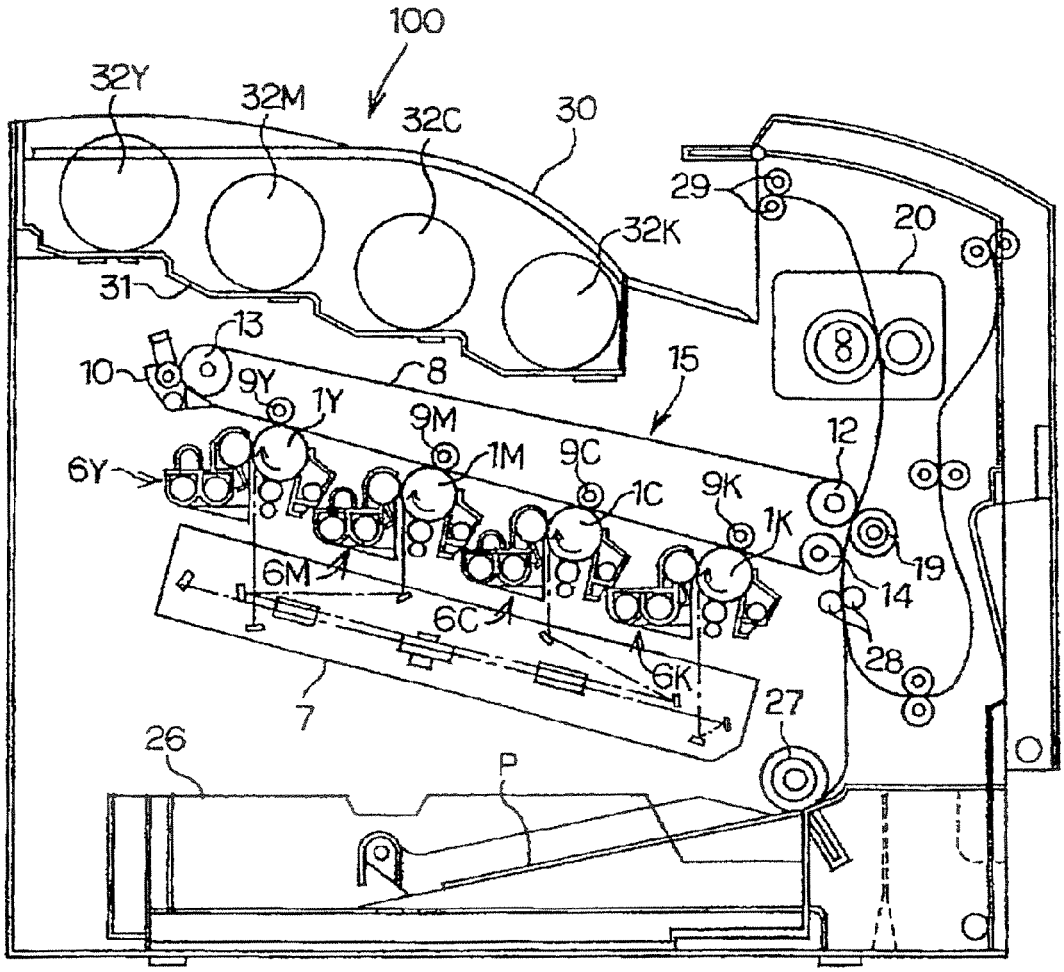
FIG. 1 is a figure showing a schematic configuration of a printer related to an embodiment of the present invention.
Figure 2:
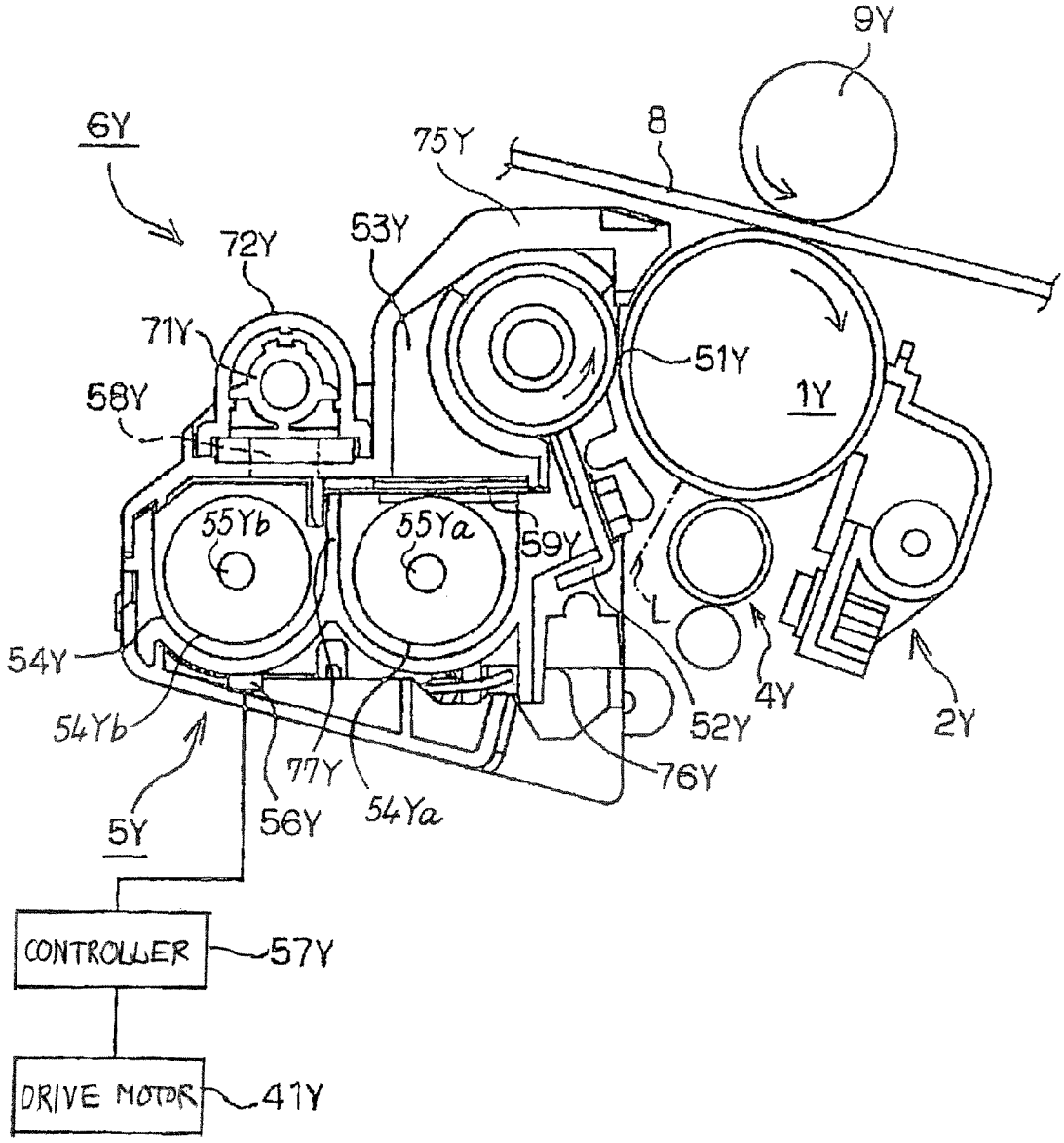
FIG. 2 is a cross-sectional view showing a schematic configuration of a Y process cartridge of the printer.

FIG. 1 shows a schematic configuration of the printer 100. In the figure, the printer 100 has four process cartridges 6Y, M, C and K for generating toner images in colors of yellow, magenta, cyan and black (marked as "Y," "M," "C" and "K" hereinafter) respectively. These process cartridges respectively use Y, M, C and K toners in different colors as image forming substances, but other configurations thereof are the same, and these process cartridges are replaced at the end of their lives. For example, the process cartridge 6Y for generating a Y toner image has, as shown in FIG. 2, a photoreceptor 1Y as a drum-like image supporter, a drum cleaning device 2Y, an electricity removing device (not shown), a charging device 4Y, a development device 5Y, and the like. This process cartridge 6Y is detachable with respect to the printer 100 main body, and wear-out parts thereof can be removed at once.

The charging device 4Y charges, uniformly, the surface of the photoreceptor that is rotated clockwise shown in the figure by driving means which is not shown. The surface of the photoreceptor 1Y, which is charged uniformly, is subjected to exposure scanning by laser beam L and then supports a Y electrostatic latent image. This Y electrostatic latent image is developed into a Y toner image by the development device 5Y that uses a Y toner. Then, the toner image formed on the photoreceptor 1Y is intermediately transferred onto an intermediate transfer roller 8. The drum cleaning device 2Y removes toner obtained after the intermediate transfer step and thereby remaining on the surface of the photoreceptor 1Y.

Moreover, the electricity removing device removes the residual electric charge of the cleaned photoreceptor 1Y. By this electricity removal, the surface of the photoreceptor 1Y is initialized to prepare for the next image formation. For the other process cartridges 6M, C and K as well, M, C and K toner images are formed on photoreceptors 1M, C and K similarly and then intermediately transferred onto an intermediate transfer belt 8.

An exposure device 7 is disposed in a lower section of the process cartridges 6Y, M, C and K that are previously shown FIG. 1. The exposure device 7, which is latent image forming means, irradiates and exposes the photoreceptor of each of the process cartridges 6Y, M, C and K with the laser beam L. By this exposure, Y, M, C and K electrostatic latent images are formed on the photoreceptors 1Y, M, C and K respectively. It should be noted that the exposure device 7 irradiates the photoreceptors by means of a plurality of optical lenses or mirrors, while using a polygon mirror, which is rotary drive by a motor, to scan the laser beam L generated from a light source.

On the lower side of the exposure device 7 shown in the figure, there is disposed paper feeding means that has a paper containing cassette 26, a feed roller 27 incorporated therein, a pair of resist rollers 28 and the like.

The paper containing cassette 26 contains a plurality of stacked transfer papers P which are recording bodies, and the feed roller 27 is in contact with the top transfer paper P. Once the feed roller 27 is rotated in a counterclockwise direction shown in the figure by the unshown driving means, the top transfer paper P is fed toward between the pair of resist rollers 28.

The pair of resist rollers 28 are rotary driven so as to slip the transfer paper P therebetween, but stop rotating once the paper is slipped therebetween. Then, the pair of resist rollers 28 sends the transfer paper P toward a secondary transfer nip, which is described hereinafter, at an appropriate time. In the paper feeding means having such a configuration, the combination of the feed roller 27 and the pair of resist rollers 28, which are timing rollers, configure convening means. This conveying means is for conveying the transfer papers P from the paper containing cassette 26, which is containing means, to the secondary transfer nip described hereinafter.

In an upper section of the process cartridges 6Y, M, C and K shown in the figure, there is disposed an intermediate transfer unit 15 for endlessly moving the intermediate transfer belt 8, which is an intermediate transfer body, while winding the intermediate transfer belt 8. This intermediate transfer unit 15 has not only the intermediate transfer belt 8 but also four primary transfer bias rollers 9Y, M, C and K, and a belt cleaning device 10. The intermediate transfer unit 15 further has a secondary transfer backup roller 12, a cleaning backup roller 13, and a tension roller 14.

The intermediate transfer belt 8 is wrapped around these three rollers and at the same time endlessly moved in the counterclockwise direction shown in the figure by the rotary drive of at least one of these rollers. The primary transfer bias rollers 9Y, M, C and K each holds the intermediate transfer belt 8 with each of the photoreceptors 1Y, M, C and K, the intermediate transfer belt being endlessly moved in the above manner, whereby a primary transfer nip is formed therebetween. Such formation of the primary transfer nips is a way to apply, to the back of the intermediate transfer belt 8 (inner periphery of the loop), a transfer bias having a polarity opposite to that of the toner.

The rollers besides the primary transfer bias rollers 9Y, M, C and K are all electrically connected to ground. During the process in which the intermediate transfer belt 8 sequentially passes through the Y, M, C and K primary transfer nips as the intermediate transfer belt 8 is moved endlessly moved, the Y, M, C and K toner images on the respective photoreceptors 1Y, M, C and K are superimposed sequentially and then primarily transferred. Accordingly, a toner image with four superimposed colors (referred to as "four-color toner image" hereinafter) is formed on the intermediate transfer belt 8.

The secondary transfer backup roller 12 and a secondary transfer roller 19 hold the intermediate transfer belt 8 therebetween to form a secondary transfer nip. The four-color toner image formed on the intermediate transfer belt 8 is transferred onto the transfer paper P at this secondary transfer nip. Transferred residual toner, which was not transferred onto the transfer paper P, remains on the intermediate transfer belt 8 that has passed through the secondary transfer nip. Such toner is cleaned off by the belt cleaning device 10.

At the secondary transfer nip, the transfer paper P is held between the intermediate transfer belt 8 and the secondary transfer roller 19 that move on the surface of each other in forward directions thereof, and then conveyed in the opposite direction from the pair of resist rollers 28. When the transfer paper P that is sent out from the secondary transfer nip passes through between rollers of a fixing device 20, the four-color toner image that has been transferred on the surface is fixed to the transfer paper P by heat and pressure. Thereafter, the transfer paper P is ejected to the outside of the machine through a pair of paper ejection rollers 29. A stack section 30 is formed on an upper surface of the printer main body, and the transfer papers P that are ejected to the outside of the machine by the pair of paper ejection rollers 29 are stacked sequentially on this stack section 30.

Furthermore, a bottle container 31 is disposed on the lower side of this stack section 30. This bottle container 31 contains toner bottles 32Y, M, C and K that are developer containers for containing the Y, M, C and K toners. The toner bottles 32Y, M, C and K are arranged downward for the respective toner colors on the bottle container 31. The Y, M, C and K toners inside the respective toner bottles 32Y, M, C and K are replenished appropriately to the development devices of the process cartridges 6Y, M, C and K respectively via a toner replenishing device, which is not shown.

Next, a configuration of the development device 5Y within the process cartridge 6Y is described using FIG. 2.

The development device 5Y has magnetic field generating means on the inside thereof, and a developing roller 51Y, which is a developer supporter that supports on the surface thereof a binary developer composed of a toner and a carrier and conveys the binary developer, is provided in a developing roller container 53Y, which is a developer supporter container. Furthermore, the developing roller 51Y is partially exposed from an opening section of a casing that forms the developing roller container 53Y, and forms a developing area in cooperation with the photoreceptor 1Y. Moreover, a developing doctor 52Y, which is a developer controlling member for controlling the thickness of a layer of developer, is provided on an upstream side in a direction of the surface movement of the developing roller 51Y from the developing area.

A developer container 54Y for containing the developer is provided on the lower side of the developing roller container 53Y, and there is also provided a communication port 59Y for communicating the developer roller container 53Y with a toner replenishing port 58Y that delivers the toner into the developer container 54Y. Moreover, the developer container 54Y is partitioned with a partition wall 77Y into a first developer container 54Ya on the developing roller 51Y side and a second developer container 54Yb on the toner replenishing port 58Y side. The first developer container 54Ya and the second developer container 54Yb each has a toner conveying screw (conveying body) for stirring and conveying the toner: a first conveying screw 55Ya; and a second conveying screw 55Yb. In an upper section of the toner replenishing port 58Y, there are provided a shutter 71Y for closing the toner replenishing port 58Y, and a toner replenishing port case 72Y that supports the shutter 71Y and covers the toner replenishing port 58Y.

The development device 5Y contains the toner and carrier as the developer in advance, and toner that is consumed through development is replenished from the toner bottle 32Y which is the toner container shown in FIG. 1, and, in response to this replenishment, is contained in the development device 5Y.

Here, a reference numeral 56Y indicates a density detecting sensor for detecting the toner density in the developer. Once this density detecting sensor 56Y detects insufficiency of the toner density within the developer container 54Y, a drive motor 41Y is rotated by transmission of a replenishment signal from a controller 57Y, and the toner bottle 32Y is rotated, whereby the toner is replenished.

In addition, the development device 5Y is formed large by an upper case 75Y having an internal wall of the developing roller container 53Y and a lower case 76Y having an internal wall of the developer container 54Y.

The operation of the development device 5Y is described next.

The toner that is replenished from the toner bottle 32Y into the development device 5Y is replenished from the toner replenishing port 58Y into the second developer container 54Yb of the developer container 54Y. The toner that is replenished into the second developer container 54Yb of the development device 5Y is stirred with the carrier by the second conveying screw 55Yb. The developer within the second developer container 54Yb that is composed of the toner and carrier is conveyed in an axial direction while being stirred by the second conveying screw 55Yb. The developer that was conveyed by the second conveying screw 55Yb and has reached an end section of the second developer container 54Yb passes through an opening section at an end section of the partition wall 77Y, and moves toward the first developer container 54Ya. The developer within the first developer container 54Ya is conveyed in the opposite direction from the developer within the second developer container 54Yb while being stirred by the first conveying screw 55Ya. Once the developer reaches an end section of the first developer container 54Ya, the developer passes through the opening section at the end section of the partition wall 77Y and moves toward the second developer container 54Yb.

In this manner, the developers are caused to circulate within the developer container 54Y by the first conveying screw 55Ya and the second conveying screw 55Yb.

Of the developer that is stirred and conveyed by the first conveying screw 55Ya in the first developer container 54Ya, developer that is drawn to the developing roller 51Y passes through the communication port 59Y, which is described hereinafter, and is then supported on the developing roller 51Y. The carrier within this developer is drawn to the developing roller 51Y by the magnetic force of a magnetic roller provided within the developing roller 51Y, and is then supported on the developing roller 51Y. The toner within this developer is stirred and thereby charged to a polarity opposite that of the carrier. Since electrostatic force is applied between the toner and carrier, the toner and the carrier are supported on the developing roller 51Y. The developer supported on the developing roller 51Y passes through a space between the developing doctor 52Y and the surface of the developing roller 51Y (doctor gap), whereby the thickness of the developer layer is controlled. Once the developer with controlled thickness is conveyed to the developing area facing the photoreceptor 1Y, the developer forms a magnetic brush on the developing roller 51Y due to the magnetic force of the magnetic roller.

Here, the surface of the developing roller 51Y moves in the developing area in the same direction as, and at a linear speed faster than, the surface of the photoreceptor 1Y. The carrier forming a magnetic brush on the developing roller 51Y supplies toner adhered to the carrier surface to the surface of the photoreceptor 1Y, while sliding on the surface of the photoreceptor 1Y. At this moment, a developing bias is applied from an unshown power source to the developing roller 51Y, whereby a development field is formed in the developing area. Between the electrostatic latent image on the photoreceptor 1Y and the developing roller 51Y, electrostatic force that is pulled toward the electrostatic latent image acts on the toner located on the developing roller 51Y. Accordingly, the toner on the developing roller 51Y adheres to the electrostatic latent image on the photoreceptor 1Y. By this adhesion, the electrostatic latent image on the photoreceptor 1Y is developed into a toner image of a corresponding color.

The communication port 59Y and communication port sealing means which are the characteristics of the present embodiment are described next.

The development device 5Y of the present embodiment is provided with the communication port 59Y for communicating the developing roller container 53Y with the first developer container 54Y, and a communication port sealing member 80Y that seals the communication port 59Y. By providing such a communication port sealing member 80Y, the developer can be prevented from leaking from an opening section of the developing roller container 53Y and dispersing when carrying the process cartridge 6Y alone. Moreover, the developer is separated from the external air, thus developer deterioration that is caused when the developer contacts with the air can be prevented from occurring.

Figure 3:
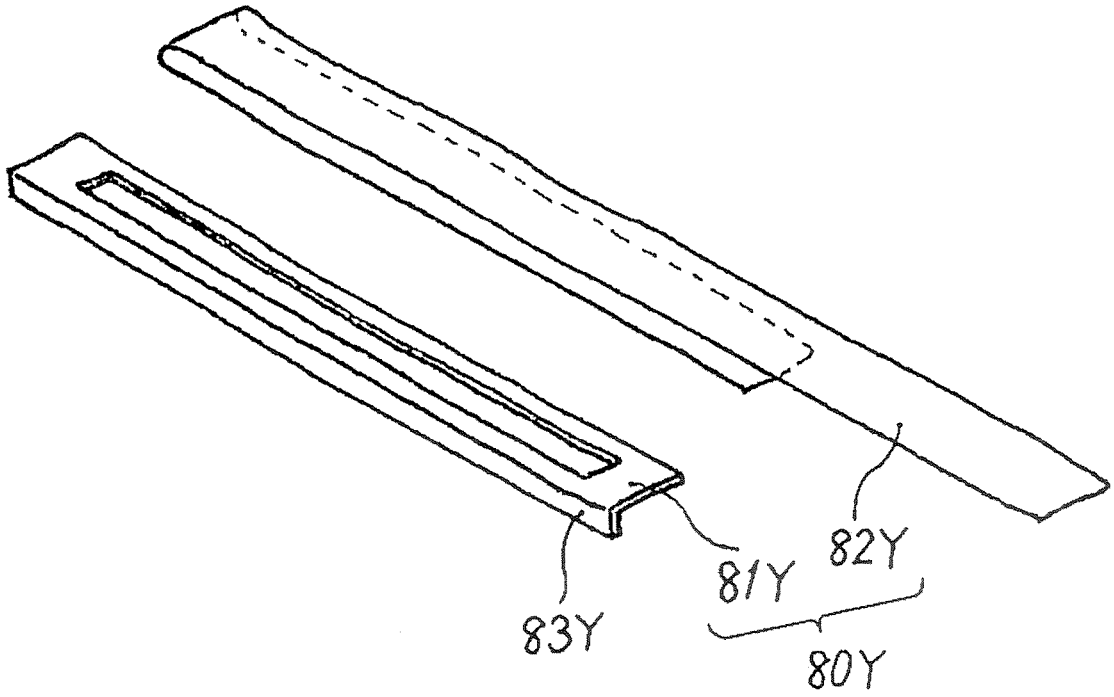
FIG. 3 is a figure showing a schematic configuration of a communication port sealing member of the process cartridge.

FIG. 3 shows a schematic configuration of the communication port sealing member 80Y. The communication port sealing member 80Y has a base member 81Y, which is a frame body forming an opening as the communication port 59Y, and a seal member 82Y, which is directly thermal compression bonded to the base member 81Y so as to cover the opening.

As shown in FIG. 3, an end section of the seal member 82Y protrudes as a pulling section from an end section of the base ember 81Y to the outside so that the seal member 82Y can be pulled out. By pulling out the pulling section of the seal member 82Y in a direction to the right parallel to the opened surface, the seal member 82Y that is thermal compression bonded to the base member 81Y is peeled off, whereby the opening formed on the base member 81Y appears, and the communication port 59Y communicating the first developer container 54Ya with the developing roller container 53Y is formed. Accordingly, the developer can be supplied from the first developer container 54Ya to the developing roller container 53Y through the communication port 59Y.

Further, the base member 81Y has a bent section 83Y, which is formed by bending a base member end section that is positioned in a direction lateral to the direction of pulling out the seal member 82Y. By providing such bent section 83Y, the strength of the force of pulling out the seal member 82Y in a direction parallel to the opened surface and thereby peeling off the seal member 82Y from the base member 81Y can be enhanced.

A resin material that is strong in bending, such as polypropylene (PP), is used as the material of the base member 81Y. The reason that a polypropylene (PP) material is used is because the formability thereof is better than that of a PET resin, and because this material is stable since cracks and scuffing are not generated even on a thick polypropylene material. In the case where cracks are generated, dusts (scums) and other foreign matters on, for example, the cracked parts can enter the developer, resulting in a defective image with white stripes and the like.

Moreover, regarding the thickness of the material, the material having a thickness of 0.8 mm or less is used. By providing the bent section 83Y in the base member 81Y, the material having such thickness can have sufficient strength, compared to a flat plate. In addition, use of the polypropylene (PP) resin is less expensive compared to use of a PET resin.

For the seal member 82Y, an easy-peel film (manufactured by Sun A Kaken Co., Ltd.) is used. The easy-peel film is a film with a four-layered structure having PET as a base material and constituted from PET25 μm/ONY/15 μm, PEF/30 μm, and KB/40 μm. The seal member 82Y constituted from this easy-peel film is directly thermal compression bonded to the polypropylene base member 81Y without using a two-sided tape, thus the two-sided tape can be prevented from abutting on the developing roller 51Y when the seal member 82Y is peeled off, or from entering the developing roller container 53Y, whereby the occurrence of defective images can be inhibited. Furthermore, compared to the production process having two steps where the two-sided tape is attached first and then the seal member is attached, this embodiment has only one step of directly thermal compression bonding the sealing member, thus the communication port sealing member can be produced easily.

Next, a method of installing the communication port sealing member 80Y is described with reference to FIG. 4A through FIG. 4C.

Figure 4A:
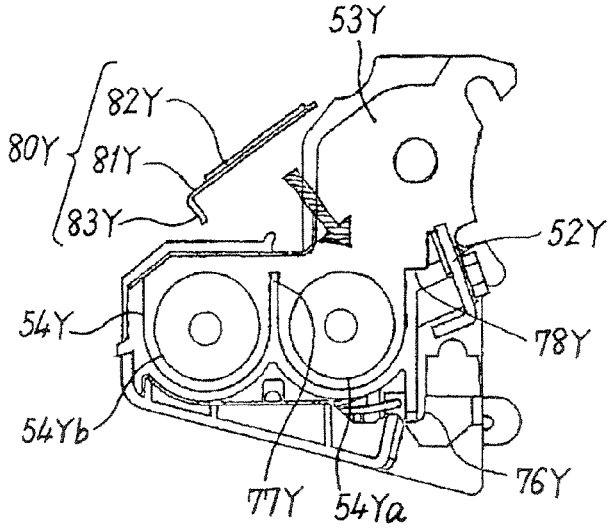
FIG. 4A through FIG. 4C are figures for explaining a method of installing the communication port sealing member.
Figure 4B:
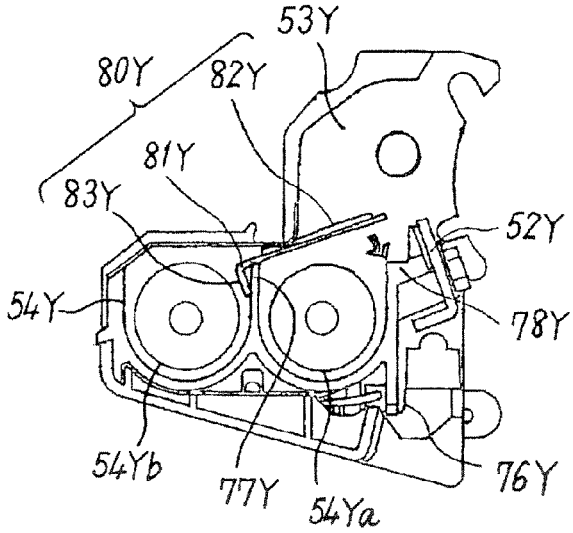
Figure 4C:
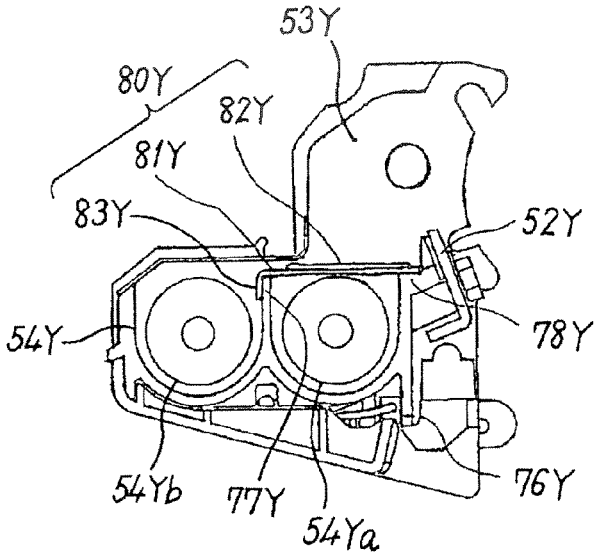

First, the communication port sealing member 80Y is brought close to the lower case 76Y (FIG. 4A). The bent section 83Y of the communication port sealing member 80Y is hooked to the partition wall 77Y of the lower case 76Y to bring the other side of the bent section 83Y gradually close to a flat surface section 78Y of the lower case 76Y (FIG. 4B). The bent section 83Y is hooked to the partition wall 77Y, the other side of the bent section 83Y is placed on the flat surface section 78Y of the lower case 76Y, and then the communication port sealing member is set so as to abut on a wall standing on the flat surface section 78Y (FIG. 4C).

After setting the communication port sealing member 80Y in this manner, the upper case 75Y is set, and the communication port sealing member 80Y is installed so as to be held between the upper case 75Y and the lower case 76Y. It should be noted that the communication port sealing member 80Y may be attached to the flat surface section 78Y of the lower case 76Y, whereby the communication port sealing member 80Y can be fitted stably. By providing the bent section 83Y in the base member 81Y in this manner, the setting properties can be improved.

Figure 5A:
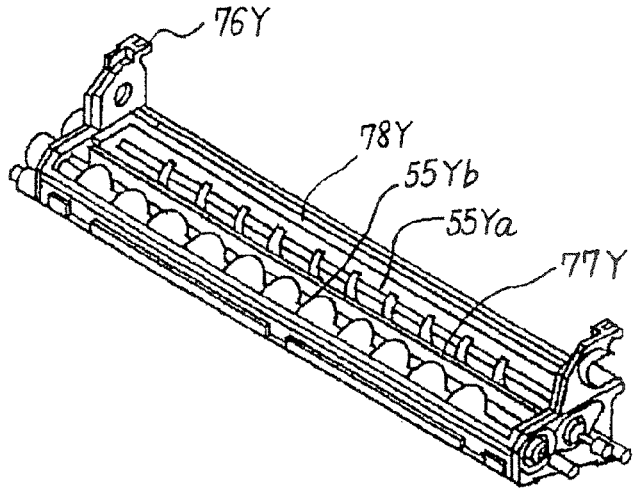
FIG. 5A through FIG. 5C are perspective views for explaining a method of setting the communication port sealing member in a lower case.
Figure 5B:
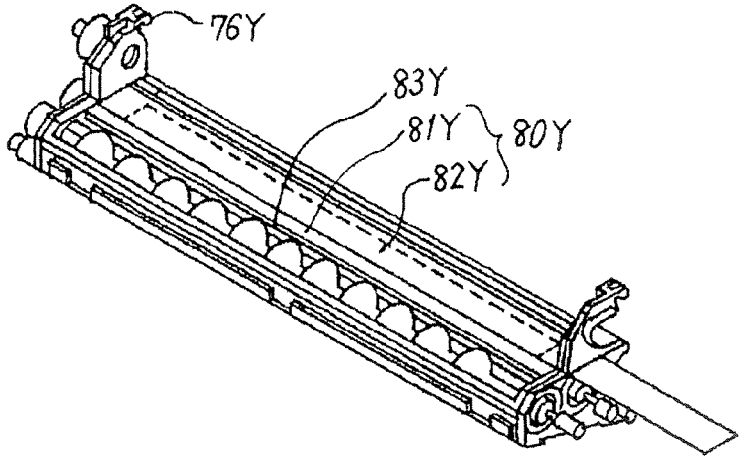
Figure 5C:
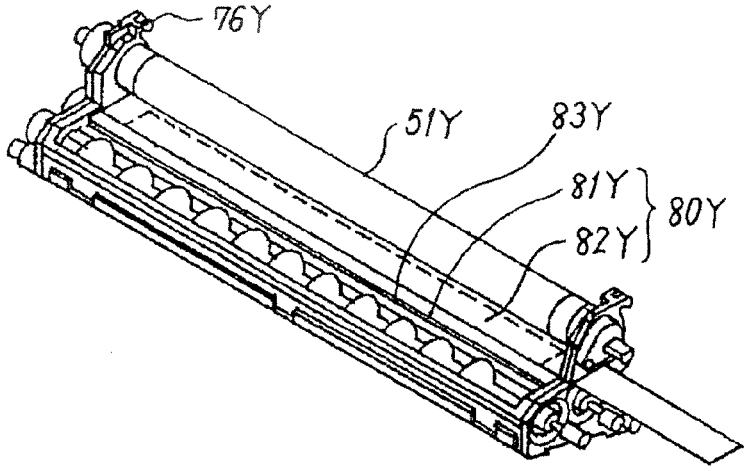

Furthermore, FIG. 5A through FIG. 5C show a state in which the communication port sealing member 80Y is set into the lower case 76Y. Specifically, FIG. 5A shows the lower case 76Y and the toner conveying screws 55Ya and 55Yb in a state in which the communication port sealing member 80Y is not yet set, FIG. 5B shows a state in which the communication port sealing member 80Y is set into the lower case 76Y, and FIG. 5C shows a state in which the communication port sealing member 80Y is set into the lower case 76Y, and then the developing roller 51Y is set.

It should be noted that in the development device 5Y of the present embodiment, the binary developer composed of a toner and a carrier is used, but a single component developer without a carrier may be used.

It should also be noted that the above embodiment describes the configuration in which the process cartridges 6Y, M, C and K that respectively have the development devices 5Y, M, C and K and the photoreceptors 1Y, M, C and K can be detached from and attached to the printer 100, but the present invention is not limited to this embodiment. The process cartridges may have at least the development devices 5Y, M, C and K, and only the development devices may be detachable with respect to the apparatus main body. The present invention can be applied to such development devices 5Y, M, C and K, and the same effects can be obtained. Moreover, the invention can also be applied to the image forming apparatus which uses the development devices 5Y, M, C and K or the process cartridges 6Y, M, C and K in which the above-described invention is implemented and, and still the same effects can be obtained.

As described above, according to the printer of the present embodiment, the base member 81Y is composed of a polypropylene resin, thus the formability thereof is better than when using a PET resin, and the bent section can be provided even in a thick base member. Therefore, a communication port sealing member that has stronger force of pulling out the seal member 82Y can be produced easily. In addition, since the base member is composed of the polypropylene resin, the communication port sealing member can be obtained inexpensively, compared to the case where a PET resin is used. Further, the seal member 82Y is directly thermal compression bonded to the polypropylene base member 81Y without using a two-sided tape, thus the occurrence of a defective image caused by a two-sided tape when peeling off the seal member 82Y can be prevented. Also, there is only one manufacturing step of directly thermal compression bonding the seal member, thus the communication port sealing member can be produced easily.

The bent section 83Y of the communication port sealing member 80Y is hooked to the partition wall 77Y of the developer container 74Y to install the communication port sealing member 80Y, whereby the setting properties can be improved.

Furthermore, the communication port sealing member 80Y is installed so as to be held between the upper case 75Y forming the developer roller container 73Y and the lower case 76Y forming the developer container 74Y, whereby the communication port sealing member 80Y can be stably supported.

Furthermore, after the communication port sealing member 80Y is attached to the lower case 76Y, the upper case 75Y is placed on the communication port sealing member 80Y so that the upper case 75Y and the lower case 76Y support the communication port sealing member 80Y therebetween, whereby the communication port sealing member 80Y can be supported more stably.

Moreover, the thickness of the base member 81 is set to 0.8 mm or less so that a light and inexpensive base member can be realized.

In addition, by configuring the process cartridge in which the photoreceptor 1Y and the development device 5Y are supported integrally, and which is detached from and attached to the image forming apparatus main body, the maintenance properties can be improved.

The above has described an embodiment of the present invention. However, according to the present invention, the development device, which has the communication port sealing means for sealing the communication port communicating the developer supporter container with the developer container, has the excellent effects, such cost reduction, easy manufacturing and formation of high-quality images.

Various modifications will become possible for those skilled in the art after receiving the teachings of the present disclosure without departing from the scope thereof.

What is claimed is:

1. A development device, comprising:

a developer supporter container for containing a developer supporter;

a developer container for containing a developer supplied to the developer supporter;

a frame body for forming a communication port that communicates the developer supporter container with the developer container; and a seal member that is adhered to the frame body so as to cover the communication port, wherein sealing of the communication port is canceled by peeling off the seal member from the frame body by pulling out the seal member in a direction parallel to an opened surface of the communication port, the frame body is composed of a polypropylene resin having a bent section, and the seal member is adhered to the frame body by thermal compression bonding.

2. The development device as claimed in claim 1, further comprising: an upper case having the developer supporter container formed thereinside; and a lower case having the developer container formed thereinside, wherein the bent section is hooked to a wall of the lower case so as to install the frame body.

3. The development device as claimed in claim 1, further comprising: an upper case having the developer supporter container formed thereinside; and a lower case having the developer container formed thereinside, wherein the upper case and the lower case sandwich and support the frame body therebetween.

4. The development device as claimed in claim 3, wherein after the frame body is attached to the lower case, the upper case is placed on the frame body so that the upper case and the lower case sandwich and support the frame body therebetween.

5. The development device as claimed in claim 1, wherein the thickness of the frame body is 0.8 mm or less.

6. A process cartridge in which at least a latent image supporter and a development device for developing a latent image on the latent image supporter are integrally supported, and which is configured detachably with respect to an image forming apparatus main body, wherein the development device comprises:

a developer supporter container for containing a developer supporter;

a developer container for containing a developer supplied to the developer supporter;

a frame body for forming a communication port that communicates the developer supporter container with the developer container; and a seal member that is adhered to the frame body so as to cover the communication port, wherein sealing of the communication port is canceled by peeling off the seal member from the frame body by pulling out the seal member in a direction parallel to an opened surface of the communication port, the frame body is composed of a polypropylene resin having a bent section, and the seal member is adhered to the frame body by thermal compression bonding.

7. An image forming apparatus, comprising:

charging means for charging a surface of a latent image supporter;

latent image forming means for forming an electrostatic latent image on the latent image supporter; and a development device for developing the electrostatic latent image to form a toner image, wherein the development device comprises:

a developer supporter container for containing a developer supporter;

a developer container for containing a developer supplied to the developer supporter;

a frame body for forming a communication port that communicates the developer supporter container with the developer container; and a seal member that is adhered to the frame body so as to cover the communication port, wherein sealing of the communication port is canceled by peeling off the seal member from the frame body by pulling out the seal member in a direction parallel to an opened surface of the communication port, the frame body is composed of a polypropylene resin having a bent section, and the seal member is adhered to the frame body by thermal compression bonding.

8. A color image forming apparatus, comprising:

charging means for charging a surface of a latent image supporter;

latent image forming means for forming an electrostatic latent image on the latent image supporter; and a plurality of development devices for developing the electrostatic latent image to form a toner image, wherein each of the development devices comprises:

a developer supporter container for containing a developer supporter;

a developer container for containing a developer supplied to the developer supporter;

a frame body for forming a communication port that communicates the developer supporter container with the developer container; and a seal member that is adhered to the frame body so as to cover the communication port, wherein sealing of the communication port is canceled by peeling off the seal member from the frame body by pulling out the seal member in a direction parallel to an opened surface of the communication port, the frame body is composed of a polypropylene resin having a bent section, and the seal member is adhered to the frame body by thermal compression bonding.

* * * * *